US007299629B2

(12) United States Patent
Betz et al.

(10) Patent No.: US 7,299,629 B2
(45) Date of Patent: Nov. 27, 2007

(54) CHARGE/AUXILIARY CIRCUIT FOR REDUCING POWER LOSSES IN HYDROSTATIC SYSTEMS

(75) Inventors: Michael A Betz, Huxley, IA (US); Jeff L Herrin, Ankeny, IA (US); Alan W Johnson, Ames, IA (US)

(73) Assignee: Sauer-Danfoss Inc., Ames, IA (US)

( * ) Notice: Subject to any disclaimer, the term of this patent is extended or adjusted under 35 U.S.C. 154(b) by 799 days.

(21) Appl. No.: 10/782,417

(22) Filed: Feb. 18, 2004

(65) Prior Publication Data

US 2005/0178117 A1 Aug. 18, 2005

(51) Int. Cl.
*F15B 11/00* (2006.01)
*F04C 2/00* (2006.01)

(52) U.S. Cl. ..... 60/488; 417/442

(58) Field of Classification Search ..... 60/464, 60/488; 417/442, 502
See application file for complete search history.

(56) References Cited

U.S. PATENT DOCUMENTS 1,961,592 A * 6/1934 Muller ..... 60/488
2,832,199 A * 4/1958 Adams et al. ..... 60/484
4,183,723 A * 1/1980 Hansen et al. ..... 417/310
4,659,296 A * 4/1987 Bristow ..... 418/15
4,751,818 A * 6/1988 Kubik ..... 60/488
5,165,233 A * 11/1992 Betz ..... 60/488
5,273,492 A 12/1993 Kashiwase et al.
5,486,089 A * 1/1996 Chung ..... 417/442
5,759,013 A * 6/1998 Miyazaki et al. ..... 417/310
6,192,682 B1 2/2001 Smothers et al.
6,386,836 B1 5/2002 Johnson
6,533,556 B1 * 3/2003 Cozens et al. ..... 417/442
6,641,372 B2 11/2003 Rytlewski et al.

* cited by examiner

*Primary Examiner*—Thomas E. Lazo

(57) ABSTRACT

A charge pump is provided with two independent outlets that can satisfy the pressure requirements of both a charge circuit and an auxiliary circuit. Preferably, the charge pump is a multiple roller vane pump that has at least one inlet and two outlets independent of each other. The first outlet is in fluid communication with a charge circuit, and the second outlet is in fluid communication with an auxiliary circuit. Because the two outlets are independent of each other, the roller vane pump is able to satisfy the pressure requirements of both the charge and auxiliary circuits. Preferably, the two outlets are diametrically opposed to each other, thereby reducing the load on the driveshaft. Additionally, the roller vane pump may include a second inlet independent of the first.

8 Claims, 2 Drawing Sheets

CHARGE/AUXILIARY CIRCUIT FOR REDUCING POWER LOSSES IN HYDROSTATIC SYSTEMS

BACKGROUND OF THE INVENTION

The present invention relates to hydrostatic charge pumps and, more specifically, to a charge pump with two independent outlets that can satisfy the pressure requirements of both a charge circuit and an auxiliary circuit.

Hydraulic systems often use a common flow source to satisfy the flow requirements of both the charge and implement or auxiliary circuits. Yet, meeting the flow requirements of both circuits often is difficult. In one conventional arrangement, the charge pump supplies pressure first to the auxiliary circuit before sending pressure to the charge circuit. If the pump is unable to meet the requirements of both circuits, however, the low pressure levels of the charge circuit can cause the hydrostatic pump to fail. In other conventional arrangements, the charge pump provides pressure to the charge circuit first, followed by the auxiliary circuit. This arrangement, however, often causes the charge circuit pressure to rise and fall in relation to the auxiliary circuit pressure requirement, causing heavier loading on the hydrostatic pump and additional hydrostatic power losses.

U.S. Pat. No. 5,165,233 to Betz attempted to solve the problems in the prior art by the use of a charge pressure priority valve. Implementation of this valve, however, requires that the pressure at the charge pump outlet always be set for the auxiliary circuit. Although use of a priority valve prevents failure or damage to the hydrostatic pump, it is not without its shortcomings. Because of the pressure drop from the auxiliary circuit requirement to that of the charge circuit, there are considerable power losses associated with the use of a priority valve.

It is therefore a principal object of this invention to provide a charge pump that can satisfy the pressure requirements of both a charge circuit and an auxiliary circuit with a minimal of power loss.

A further object of this invention is to provide a charge pump that can satisfy the pressure requirements of both a charge circuit and an auxiliary circuit using two independent discharge outlets.

These and other objects will be apparent to those skilled in the art.

BRIEF SUMMARY OF THE INVENTION

The present invention is directed toward a charge pump with two independent outlets that can satisfy the pressure requirements of both a charge circuit and an auxiliary circuit. Preferably, the charge pump is a multiple roller vane pump that has at least one inlet and two outlets independent of each other. The first outlet is in fluid communication with a charge circuit, and the second outlet is in fluid communication with an auxiliary circuit. Because the two outlets are independent of each other, the roller vane pump is able to independently satisfy the pressure requirements of both the charge and auxiliary circuits. Preferably, the two outlets are diametrically opposed to each other, thereby reducing the load on the driveshaft. Additionally, the roller vane pump may include a second inlet independent of the first.

DESCRIPTION OF THE PREFERRED EMBODIMENTS OF THE INVENTION

Figure 1:
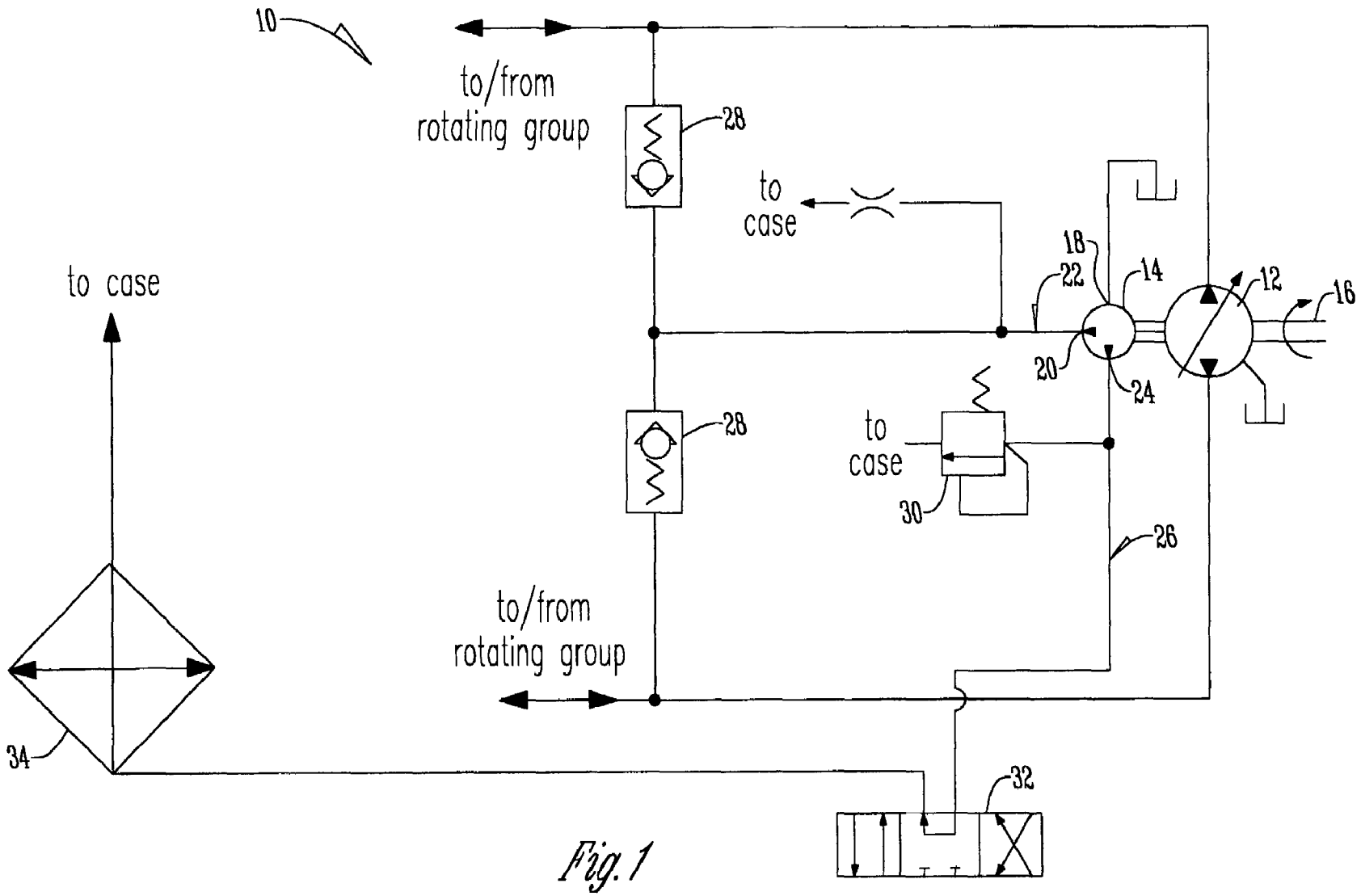
FIG. 1 is a process and instrument diagram of a hydraulic system of the present invention.

With reference to FIG. 1, a hydraulic system 10 is shown that includes a hydrostatic pump 12 and a charge pump 14 both driven by a driveshaft 16. Charge pump 14 has a fluid inlet 18, a charge outlet 20 to supply a charge circuit 22, and an auxiliary outlet 24 to supply an implement or auxiliary circuit 26. Charge circuit 22 includes a pair of cross check valves 28. Auxiliary circuit 26 includes an implement relief valve 30 that returns the auxiliary flow to the pump case and an implement valve 32 that sends the auxiliary flow through a heat exchanger 34. Outlets 20 and 24 are independent of each other such that charge pump 14 can supply hydraulic fluid at one pressure to charge circuit 22 and hydraulic fluid at a different pressure to auxiliary circuit 26. Charge outlet 20 and auxiliary outlet 24 may be arranged as shown in FIG. 1 such that they are offset by approximately 90°. Alternatively, the outlets 20 and 24 may be diametrically opposed, or offset by approximately 180°. The load placed on the hydrostatic pump shaft 16 is minimized when the outlets 20 and 24 are diametrically opposed. Additionally, pump 14 may include a second inlet (not shown) that is independent from inlet 18.

Figure 2:
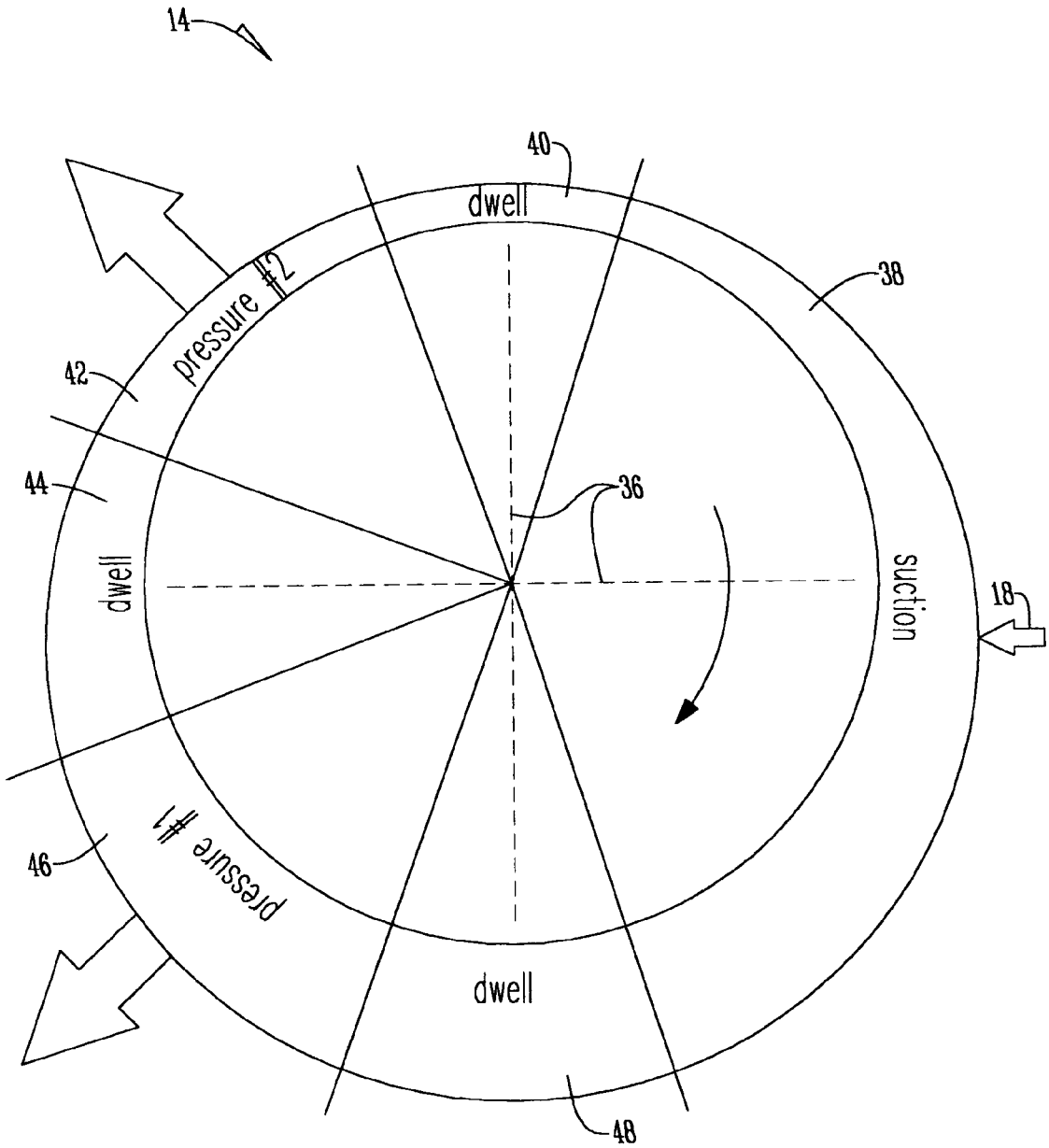
FIG. 2 is a cycle diagram of a roller vane charge pump of the present invention.

As shown in FIG. 2, charge pump 14 preferably is a multiple roller vane pump with vanes 36. Pump 14 includes a suction region 38, a first dwelling region 40, a first pressure region 42, a second dwelling region 44, a second pressure region 46, and a third dwelling region 48. Pump inlet 18 is in fluid communication with suction region 38, while charge outlet 20 is in fluid communication with first pressure region 42 and auxiliary outlet 24 is in fluid communication with second pressure region 46. In the arrangement shown in FIG. 2, outlets 20 and 24 are offset by approximately 90°. The suction region 38 may be reduced in size and the second dwelling region 44 may be increased such that outlets 20 and 24 are diametrically opposed, or offset by approximately 180°.

In operation, pump 14 rotates in a clockwise direction, as indicated in FIG. 2. As the vanes 36 of pump 14 sweep through suction region 38, hydraulic fluid is taken in from inlet 18. As the vanes 36 pass through first dwelling region 48, the fluid volume is transitioned from inlet pressure to the pressure in region 42. In region 42, the rollers are displaced to provide the flow requirements of the charge circuit 22. As the vanes 36 sweep through second dwelling region 44, the hydraulic fluid will be transitioned to the pressure of region 46. In region 46, the rollers are displaced to provide the flow requirements of the auxiliary circuit 26. Vanes 36 further sweep through third dwelling region 48 to prepare the pump 14 for another complete cycle. The arrangement of the various regions within pump 14 may be altered to achieve the specific displacement requirements of both the charge circuit 22 and the auxiliary circuit 26. As such, no excess power is lost due to combining the pressure and flow needs of the charge and auxiliary circuits as the pump 14 passes through each cycle.

It is therefore seen that by the use of a charge pump with two independent outlets, this invention satisfies the pressure requirements of both the charge and auxiliary circuits with a minimal of power loss.

What is claimed is:

1. A hydraulic system comprising:

a hydrostatic pump in fluid communication with the hydraulic system and driven by a driveshaft, a charge pump driven by the driveshaft and having an inlet in fluid communication with the hydraulic system and a first and second outlet, a charge circuit in fluid communication with the first outlet, an auxiliary circuit in fluid communication with the second outlet, and the first and second outlets being independent of each other.

2. The hydraulic system of claim 1 wherein the charge pump is a multiple roller vane pump.

3. The hydraulic system of claim 2 wherein the first and second outlets are diametrically opposed to each other.

4. The hydraulic system of claim 2 wherein the roller vane pump has a second inlet independent of the first inlet.

5. The hydraulic system of claim 1 wherein the charge pump is a vane pump.

6. A roller vane pump for a hydraulic system comprising:

an inlet in fluid communication with the hydraulic system, a suction region, first dwelling region, a first pressure region, a second dwelling region, a second pressure region and third dwelling section fluidly connected to the inlet;

a first outlet in fluid communication with a first hydraulic circuit and in fluid communication with the first pressure region, a second outlet in fluid communication with a second hydraulic circuit and in fluid communication with the second pressure region, the first and second outlets being independent of each other;

wherein a plurality of vanes sweep through the regions to complete a pump cycle.

7. The roller vane pump of claim 6 wherein the first and second outlets are diametrically opposed to each other.

8. The roller vane pump of claim 6 further comprising a second inlet independent of the first inlet.

* * * * *